US009789510B2

(12) United States Patent
Feng et al.

(10) Patent No.: US 9,789,510 B2
(45) Date of Patent: Oct. 17, 2017

(54) ADHESIVE DISPENSING DEVICE

(71) Applicants: Fu Tai Hua Industry (Shenzhen) Co., Ltd., Shenzhen (CN); HON HAI PRECISION INDUSTRY CO., LTD., New Taipei (TW)

(72) Inventors: Jun Feng, Shenzhen (CN); Wei Wu, Shenzhen (CN)

(73) Assignees: Fu Tai Hua Industry (Shenzhen) Co., Ltd., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 86 days.

(21) Appl. No.: 15/008,697

(22) Filed: Jan. 28, 2016

(65) Prior Publication Data

US 2017/0151582 A1 Jun. 1, 2017

(30) Foreign Application Priority Data

Nov. 27, 2015 (CN) ..... 2015 2 0959425 U

(51) Int. Cl.

| | |
|---|---|
| ***B65D 47/02*** | (2006.01) |
| ***B05C 5/00*** | (2006.01) |
| ***B05C 5/02*** | (2006.01) |
| ***B05C 17/005*** | (2006.01) |

(52) U.S. Cl.

CPC ..... *B05C 5/001* (2013.01); *B05C 5/0225* (2013.01); *B05C 17/00576* (2013.01)

(58) Field of Classification Search

CPC .... B05C 5/001; B05C 5/025; B05C 17/00576
USPC ..... 222/146.2, 146.1, 146.5, 386, 333; 219/422–426; 239/132.1, 135
See application file for complete search history.

(56) References Cited

U.S. PATENT DOCUMENTS

| | | | | |
|---|---|---|---|---|
| 4,215,802 A * | 8/1980 | Ornsteen | B05C 17/00543 | 222/146.2 |
| 4,795,126 A * | 1/1989 | Crandell | B22D 17/2272 | 219/424 |
| 5,855,301 A * | 1/1999 | Mykkanen | G11B 5/4853 | 222/192 |
| 6,223,950 B1 * | 5/2001 | Lasko | B05C 17/0053 | 219/426 |
| 6,797,952 B2 * | 9/2004 | Kaito | B82Y 35/00 | 250/201.3 |

* cited by examiner

*Primary Examiner* — Lien Ngo
(74) *Attorney, Agent, or Firm* — Steven Reiss

(57) ABSTRACT

An adhesive dispensing device includes a dispensing tube, a dispensing needle fixed to a bottom end portion of the dispensing tube and configured to dispense adhesive received in the dispensing tube, a heating sleeve surrounding the dispensing needle and configured to slide along a length of the dispensing needle and heat the dispensing needle, and a driving assembly. The driving assembly drives the heating sleeve to slide along a length of the dispensing needle to reveal an end portion of the dispensing needle or cover the end portion of the dispensing needle.

10 Claims, 4 Drawing Sheets

ADHESIVE DISPENSING DEVICE

FIELD

The subject matter herein generally relates to a dispensing device for dispensing adhesive.

BACKGROUND

Generally, an adhesive dispensing device dispenses adhesive in a liquid form. The adhesive may be stored inside a storage portion of the adhesive dispensing device.

BRIEF DESCRIPTION OF THE DRAWINGS

Implementations of the present technology will now be described, by way of example only, with reference to the attached figures.

DETAILED DESCRIPTION

Figure 1:
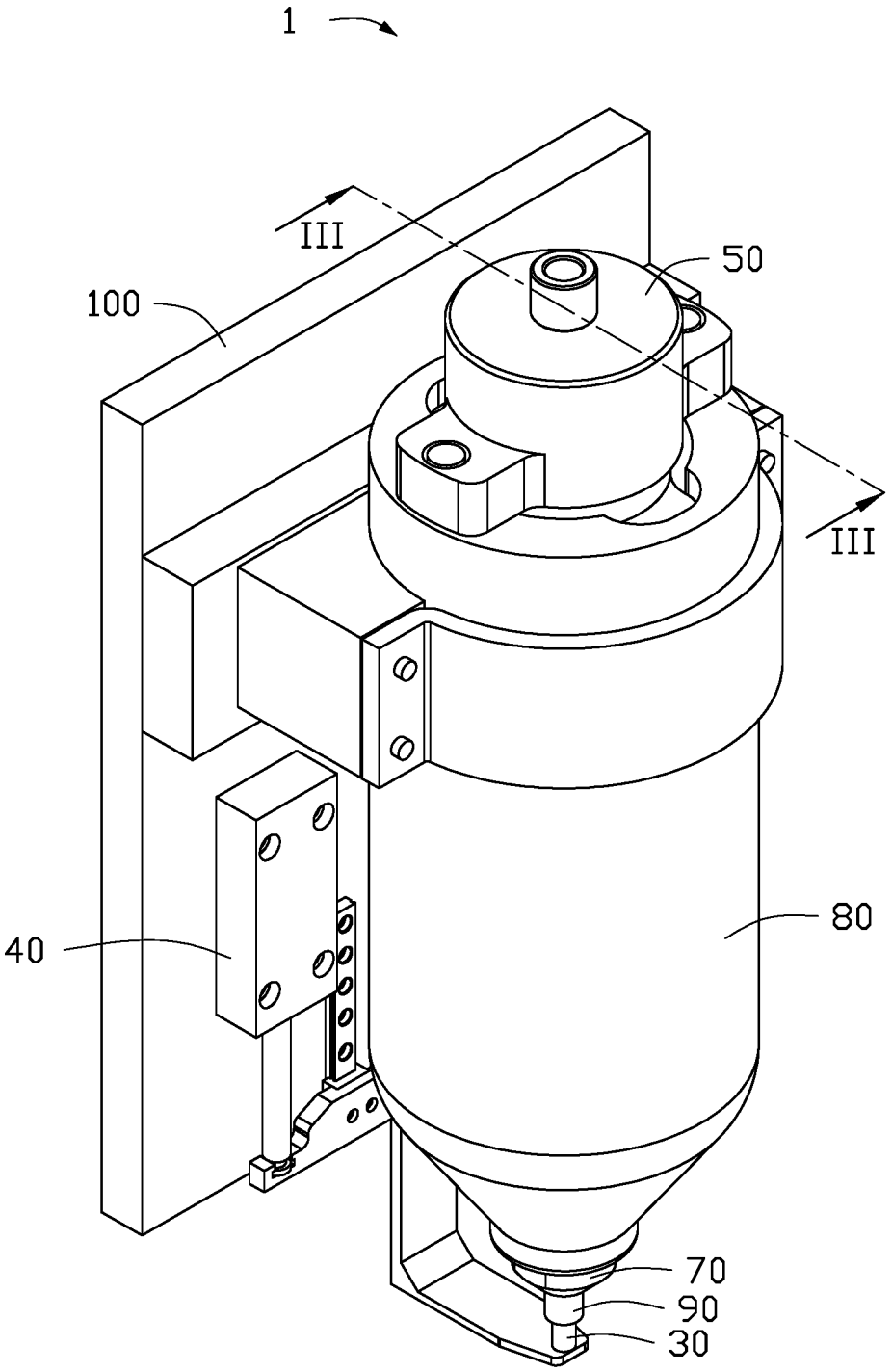
FIG. 1 is an assembled isometric view of an embodiment of an adhesive dispensing device.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "substantially" is defined to be essentially conforming to the particular dimension, shape, or other word that "substantially" modifies, such that the component need not be exact. For example, "substantially cylindrical" means that the object resembles a cylinder, but can have one or more deviations from a true cylinder. The term "comprising" means "including, but not necessarily limited to"; it specifically indicates open-ended inclusion or membership in a so-described combination, group, series and the like.

FIG. 1 illustrates an embodiment of an adhesive dispensing device 1. The adhesive dispensing device 1 can be fully automatic.

Figure 2:
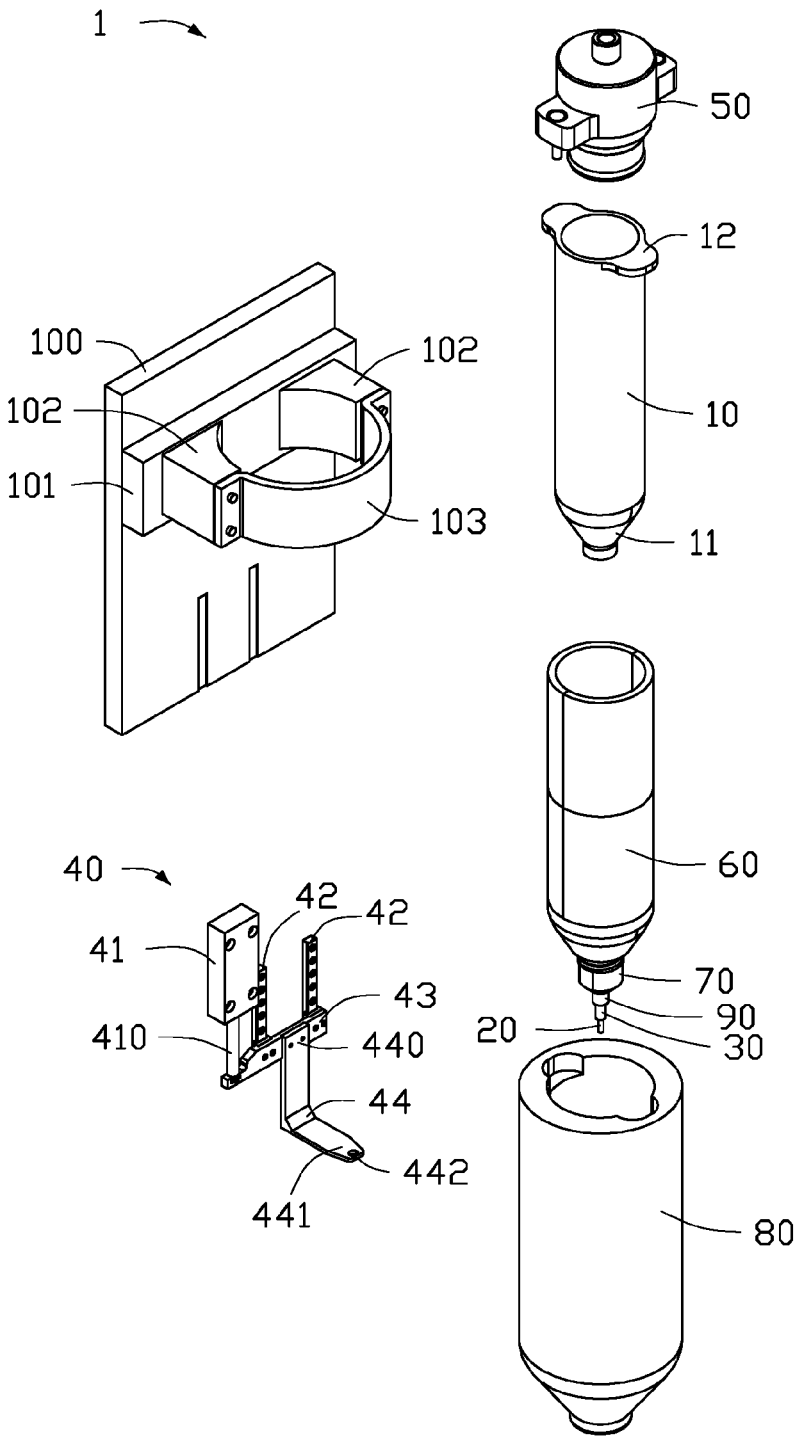
FIG. 2 is an exploded view of FIG. 1.

As illustrated in FIG. 1 and FIG. 2, the adhesive dispensing device 1 can include a dispensing tube 10, a dispensing needle 20, a heating sleeve 30, and a driving assembly 40. The dispensing needle 20 can be fixed to a bottom end portion 11. The heating sleeve 30 can heat the dispensing needle 20. The driving assembly 40 can grasp the heating sleeve 30 and drive the heating sleeve 30 to slide along a length of the dispensing needle 20 to reveal an end portion of the dispensing needle 20 or cover the end portion of the dispensing needle 20.

The adhesive dispensing device 1 can include a piston 50 arranged on a top end portion 12 of the dispensing tube 10. The piston 50 uses pressurized air to drive the dispensing tube 10 to dispense adhesive through the dispensing needle 20.

The adhesive dispensing device 1 can include a second heating sleeve 60. The second heating sleeve 60 can surround the dispensing tube 10 and heat the dispensing tube 10.

The adhesive dispensing device 1 can include a first cylinder 70 and a second cylinder 80. The first cylinder 70 can be fixed to an end of the second heating sleeve 60 and hold the dispensing needle 20 in place. The second cylinder 80 can surround the second heating sleeve 60 and hold the second heating sleeve 60 in place.

When the end portion of the dispensing needle 20 is revealed, the heating sleeve 30 is received in a space defined between the first cylinder 70 and the dispensing needle 20, and an end portion of the heating sleeve 30 is partially extended out of the first cylinder 70. The end portion of the heating sleeve 30 is grasped by the driving assembly 40.

The adhesive dispensing device 1 can include a third cylinder 90 received in a space defined between the first cylinder 70 and the heating sleeve 30. The third cylinder 90 can resist against the heating sleeve 30 when the driving assembly 40 drives the heating sleeve 30 to extend out of the first cylinder 70.

The adhesive dispensing device 1 can include a mounting board 100, a mounting seat 101, two mounting pieces 102, and a fixing element 103. The mounting seat 101 can be fixed to the mounting board 100. The two mounting pieces 102 can be fixed to the mounting seat 101. The fixing element 103 can be arcuate and fixed between the two mounting pieces 102. The dispensing tube 10 can be received in a receiving space cooperatively defined by the mounting seat 101, the two mounting pieces 102, and the fixing element 103 to be mounted on the mounting board 100.

The driving assembly 40 can be fixed to the mounting board 100 and include an air cylinder 41, two sliding rails 42, a sliding member 43, and a grasping member 44. The air cylinder includes an extendable pole 410 fixed to the sliding member 43. The sliding member 43 can slide along the two sliding rails 42. The grasping member 44 can be fixed to the sliding member 43. In the illustrated embodiment, the grasping member 44 can be located in a substantially central portion of the sliding member 43.

The grasping member 44 can be substantially L-shaped and include a first section 440 and a second section 441. The first section 440 can be fixed to the sliding member 43 and be located in a substantially central portion of the sliding member 43. A hole 442 can be defined in the second section 441. The second section 442 can grasp the heating sleeve 30 by the heating sleeve 30 passing through the hole 442.

The air cylinder 41 can drive the extendable pole 410 to extend or contract, thereby driving the sliding member 43 to slide along the two sliding rails 42. The grasping member 44 fixed to the sliding member 43 drives the heating sleeve 30 to cover the end portion of the dispensing needle 20 or reveal the end portion of the dispensing needle 20. When the heating sleeve 30 covers the end portion of the dispensing needle 20, the heating sleeve 30 can heat the dispensing needle 20 to prevent adhesive from solidifying inside the dispensing needle 20. When the heating sleeve 30 reveals the end portion of the dispensing needle 20, the dispensing tube 10 can dispense the adhesive through the dispensing needle 20.

Figure 3:
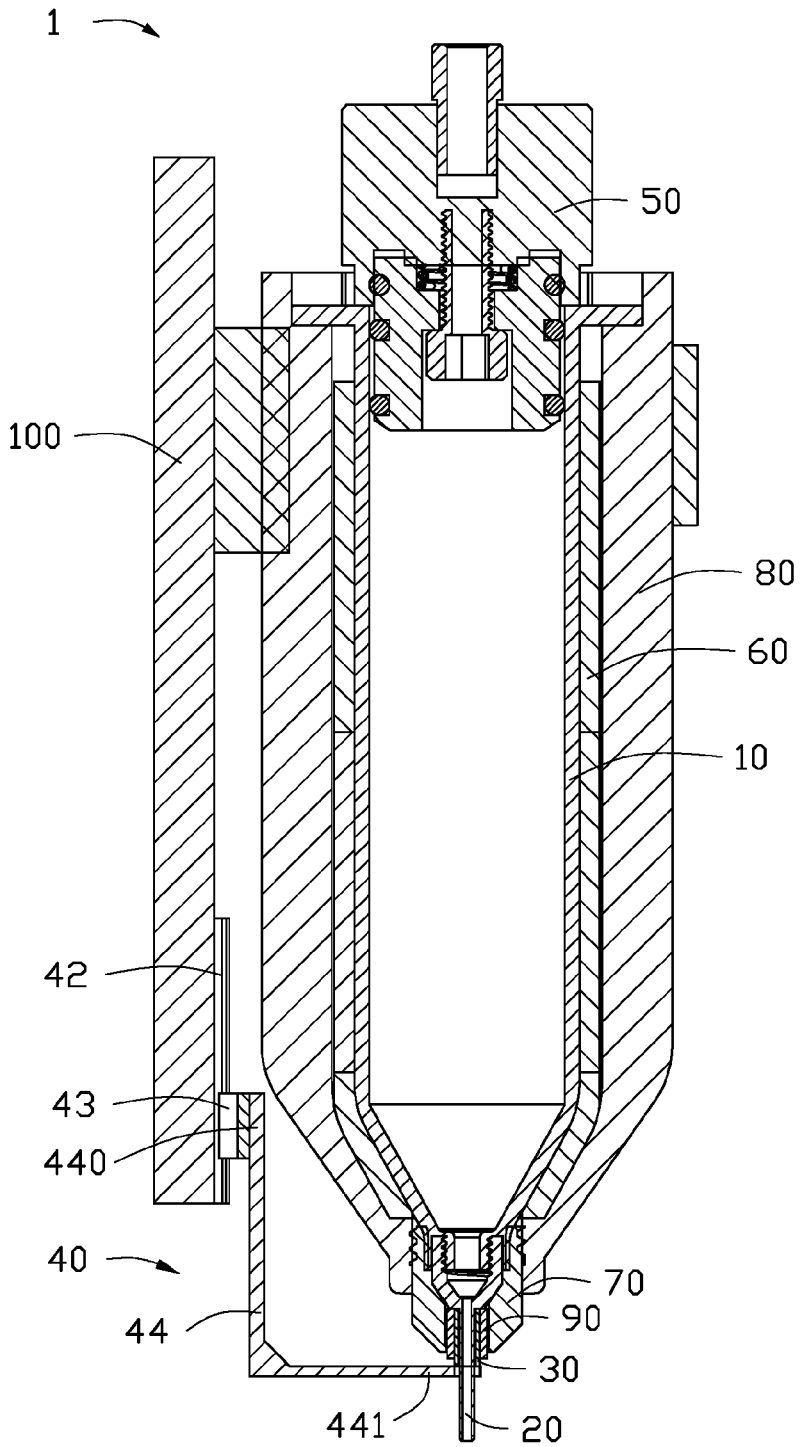
FIG. 3 is a cross-sectional view taken along line III-III of FIG. 1.

As illustrated in FIG. 3, when the adhesive dispensing device 1 dispenses adhesive, the third cylinder 90 is received in the first cylinder 70, the heating sleeve 30 is received in the space defined between the third cylinder 90 and the dispensing needle 20 and partially extended out of the first cylinder 70, and the grasping member 44 grasps the end portion of the heating sleeve 30 partially extended out of the first cylinder 70.

Figure 4:
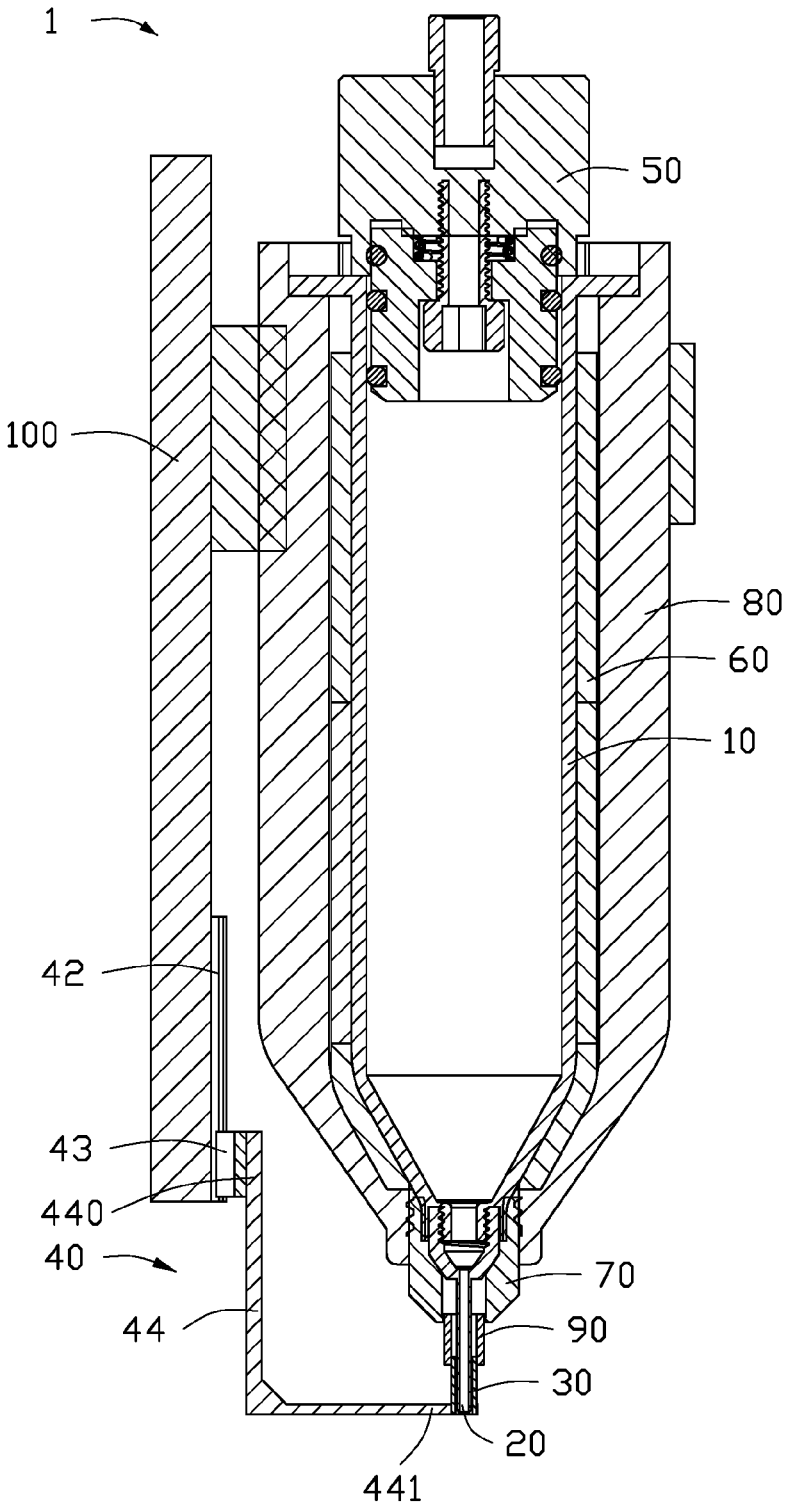
FIG. 4 is similar to FIG. 3 but shows the adhesive dispensing device in a state of use.

As illustrated in FIG. 4, when the adhesive dispensing device 1 does not dispense adhesive, the air cylinder 41 drives the extendable pole 410 to drive the sliding member 43 to slide along the sliding rails 42. The grasping member 44 fixed to the sliding member 43 drives the heating sleeve 30 to cover the end portion of the dispensing needle 20 to heat the dispensing needle 20.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including, the full extent established by the broad general meaning of the terms used in the claims.

What is claimed is:

1. An adhesive dispensing device comprising:

a dispensing tube;

a dispensing needle fixed to a bottom end portion of the dispensing tube and configured to dispense adhesive received from the dispensing tube;

a heating sleeve surrounding the dispensing needle and configured to slide along a length of the dispensing needle and heat the dispensing needle; and a driving assembly configured to drive the heating sleeve to slide along the dispensing needle to expose an end portion of the dispensing needle or cover the end portion of the dispensing needle.

2. The adhesive dispensing device as in claim 1, comprising a piston arranged on a top end portion of the dispensing tube, the piston configured to drive the adhesive in the dispensing tube to dispense through the dispensing needle.

3. The adhesive dispensing device as in claim 1, comprising a second heating sleeve surrounding the dispensing tube and configured to heat the dispensing tube.

4. The adhesive dispensing device as in claim 3, comprising:

a first cylinder fixed to an end of the second heating sleeve and configured to hold the dispensing needle in place; and a second cylinder surrounding the second heating sleeve and configured to hold the second heating sleeve in place.

5. The adhesive dispensing device as in claim 4, wherein:

when the end portion of the dispensing needle is revealed, the heating sleeve is received in a space between the first cylinder and the dispensing needle and an end portion of the heating sleeve is partially extended out of the first cylinder; and the driving assembly grasps the end portion of the heating sleeve.

6. The adhesive dispensing device as in claim 4, comprising:

a third cylinder received in a space between the first cylinder and the heating sleeve and configured to resist against the heating sleeve when the driving assembly drives the heating sleeve to extend out of the first cylinder.

7. The adhesive dispensing device as in claim 1, comprising:

a mounting board;

a mounting seat fixed to the mounting board;

two mounting pieces fixed to the mounting seat; and a fixing element fixed between the two mounting pieces;

wherein the fixing element is arcuate; and the dispensing tube is received in a receiving space cooperatively defined by the mounting seat, the two mounting pieces, and the fixing element to be mounted on the mounting board.

8. The adhesive dispensing device as in claim 7, wherein:

the driving assembly is mounted on the mounting board;

the driving assembly comprises an air cylinder, two sliding rails, a sliding member, and a grasping member;

the air cylinder comprises an extendable pole;

the extendable pole is fixed to the sliding member;

the sliding member is mounted on the two sliding rails and configured to slide along the two sliding rails; and the grasping member is mounted on the sliding member.

9. The adhesive dispensing device as in claim 8, wherein:

the grasping member comprises a first section and a second section;

the first section is fixed to the sliding member; and the heating sleeve passes through a hole defined in the second section to be grasped by the second section.

10. The adhesive dispensing device as in claim 9, wherein:

the air cylinder drives the extendable pole to extend or contract, thereby driving the sliding member to slide along the two sliding rails; and the grasping member fixed to the sliding member drives the heating sleeve to cover the end portion of the heating needle or uncover the end portion of the heating needle.

* * * * *